United States Patent [19]

Cole et al.

[11] Patent Number: 4,571,866

[45] Date of Patent: Feb. 25, 1986

[54] ADJUSTABLY MOUNTABLE DISPLAY FRAME

[75] Inventors: Mark T. Cole, W. Groton; Charles F. Sherman, Townsend, both of Mass.

[73] Assignee: Nielsen Moulding Design Corp., Townsend, Mass.

[21] Appl. No.: 639,132

[22] Filed: Aug. 9, 1984

Related U.S. Application Data

[63] Continuation of Ser. No. 499,362, May 31, 1983, abandoned.

[51] Int. Cl.[4] ..... A47G 1/06; G09F 1/12

[52] U.S. Cl. ..... 40/152.1; 248/496

[58] Field of Search ..... 40/152.1, 152; D8/354, D8/373; 248/489, 495, 496

[56] References Cited

U.S. PATENT DOCUMENTS

D. 266,144 9/1982 Wallace ..... D8/354

4,161,977 7/1979 Baslow ..... 403/401

4,428,135 1/1984 Sobel ..... 40/155

*Primary Examiner*—Robert P. Swiatek

*Assistant Examiner*—Cary E. Stone

*Attorney, Agent, or Firm*—John E. Toupal; Harold G. Jarcho

[57] ABSTRACT

The invention is an apparatus for mounting a display item on a vertical support surface and includes a frame assembly with elongated side members each having one end joined with a different end of an elongated top member and an opposite end joined with a different end of an elongated bottom member, the members forming a rectangular enclosure for retaining a peripheral edge of the display item. Disposed on the rear surface of the frame assembly is a retainer that retains a mounting member movable along a path substantially parallel to the elongated top member. The mounting member is adapted to removably engage and be supported by an appendage fixed to the support surface.

10 Claims, 4 Drawing Figures

ADJUSTABLY MOUNTABLE DISPLAY FRAME

CROSS-REFERENCE TO RELATED APPLICATION

This application is a continuation of U.S. application Ser. No. 499,362, entitled "Adjustably Mountable Display Frame", filed May 31, 1983 abandoned.

BACKGROUND OF THE INVENTION

This invention relates generally to a frame apparatus for a display article and, more particularly, to a frame in which a display article can be easily and symmetrically mounted on a vertical surface.

There exist many types of frame structures for mounting display items on a vertical surface. Normally, the frame structures have a rectangular shape and are intended for orthogonally symmetrical mounting with side edges oriented vertically and top and bottom edges oriented horizontally. The frames generally are hung from either a nail or screw imbedded in the vertical support surface. Typical mounting structures include either wires or cords having ends attached to the rear surfaces of the frame's vertical side pieces and serrated brackets secured to the rear surface of the frame's upper perimeter. All such prior arrangements render rather difficult symmetrical mounting of displays. For example, a specifically desired display elevation is not easily attained with flexible cord support structures. Conversely, accurate plumbing of a display is difficult with a serrated bracket in that the plurality of notches available on the rear mounted bracket are concealed from view during the hanging process. For that reason, one cannot easily align a supporting nail with a particular serrated bracket notch that will establish an orthogonally symmetrical orientation for a display frame.

The object of this invention, therefore, is to provide an improved display frame apparatus that can be more easily mounted in an orthogonally symmetrical orientation on a vertical support surface.

SUMMARY OF THE INVENTION

The invention is an apparatus for mounting a display item on a vertical support surface and includes a frame assembly with elongated side members each having one end joined with a different end of an elongated top member and an opposite end joined with a different end of an elongated bottom member, said members forming a rectangular enclosure for retaining a peripheral edge of the display item. Disposed on the rear surfaces of the frame assembly is a retainer means that retains a mounting member movable along a path substantially parallel to the elongated top member. The mounting member is adapted to removably engage and be supported by an appendage fixed to the support surface. Horizontal adjustment of the mounting member on the retainer means facilitates orthogonally symmetrical positioning of the frame assembly on the support surface.

According to features of the invention the top member comprises an elongated extrusion forming a channel with a pair of longitudinally extending parallel lips separated by a rearwardly opening slot. The lips have surfaces that engage a retainer portion of the mounting member which also includes an attachment portion disposed externally of the channel and engagable with the appendage. This arrangement facilitates the symmetrical hanging of a frame assembly formed from economical sections of metal extrusion.

According to other features of the invention the retainer portion comprises a pair of spaced apart extension portions engaging an outer surface of one of the lips, a pair of spaced apart projection portions engaging an inner surface of the other of the lips, and a resilient latch portion disposed between the extension portions and engaging an inner surface of the one lip. The projection portions and the latch portion are spaced apart by a distance greater than the separation of the lips such that entry of the latch portion into the channel requires temporary deformation thereof. Secure retention of the mounting member within the retainer channel is insured by the lip engaging projection, extension and latch portions.

According to yet another feature of the invention the hanger portion of the mounting member defines a serrated edge extending parallel to the top member and between the projection portions. The serrated edge facilitates hanging of the frame assembly by providing a plurality of notches for selective engagement with the supporting appendage.

According to still other features of the invention the latch portion comprises a flexible arm extending into the retainer channel and having an intermediate portion projecting away from the retainer portion and a terminal portion projecting from the intermediate portion towards the retainer portion. The flexible arm is deformed by engagement of the terminal portion with an edge of the one lip during entry into the channel and the intermediate portion maintains a resilient force on the inner surface of the one lip that securely retains the mounting member within the channel during horizontal adjustment therein.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
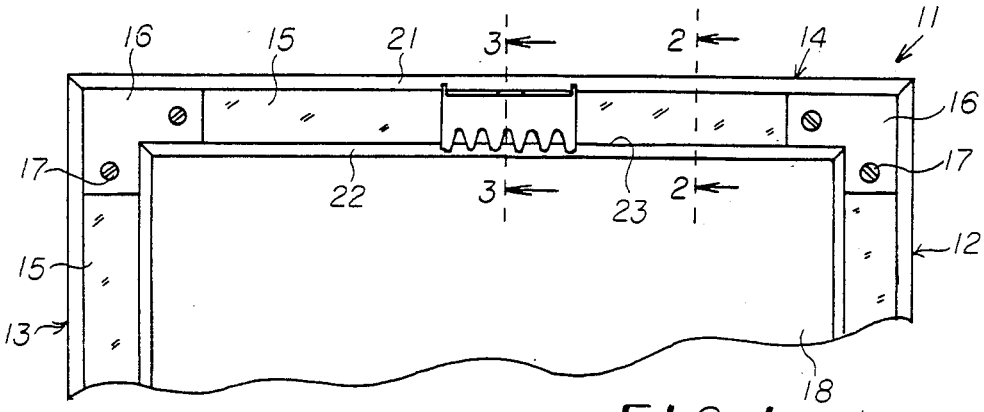
FIG. 1 is a partially cut away schematic rear view of a display frame according to the invention.
Figure 2:
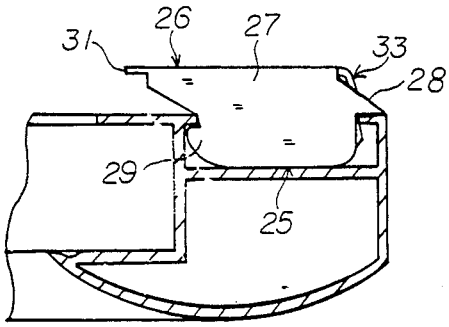
FIG. 2 is a schematic cross-sectional view taken along the lines 2—2 of FIG. 1.
Figure 3:
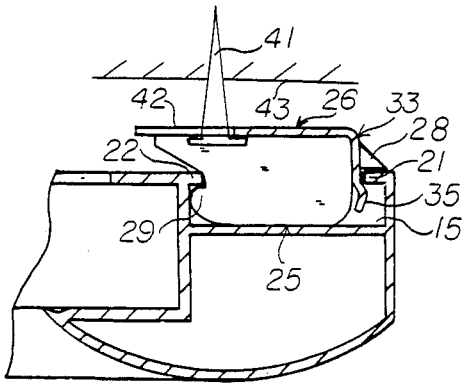
FIG. 3 is a schematic cross-sectional view taken along lines 3—3 of FIG. 1.

Referring now to FIG. 1 there is shown the rear surface of a frame apparatus 11 constructed according to the present invention. The frame 11 includes a pair of parallel, spaced apart and elongated side members 12, 13 with mitered upper ends, respectively, orthogonally joined to opposite mitered ends of an elongated top member 14. Preferably the members 12-14 are metal extrusions having rearwardly opening channels 15 as shown in FIGS. 2 and 3. Attaching the joined end of the members 12-14 are angled mounting plates 16 that are retained by the channels 15 and secured therein by screws 17. As shown in FIGS. 1-3, the channel 15 is partially formed by a pair of longitudinally extending parallel lips 21, 22 separated by a rearwardly opening slot 23. The lower ends of the side members 12, 13 are similarly joined to an elongated bottom member (not shown) to form a rectangular enclosure for the peripheral edge of a display item 18.

Figure 4:
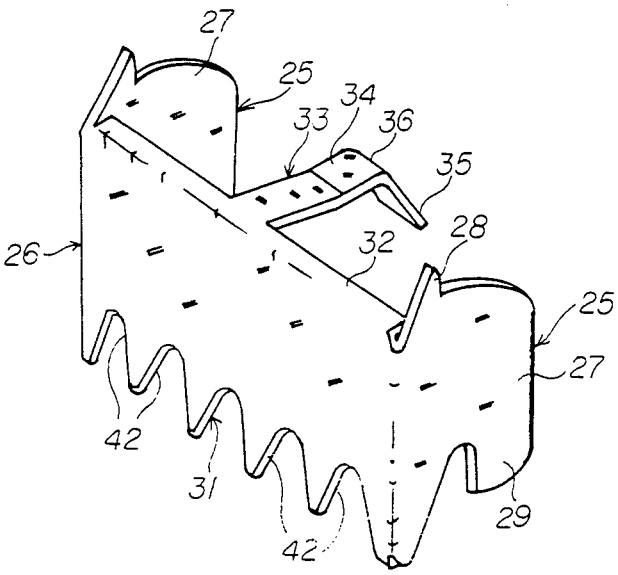
FIG. 4 is a schematic perspective view of a mounting member shown in FIGS. 1-3.

Illustrated most clearly in FIGS. 2–4 is a mounting member that is retained by the retainer channel 15 in the top frame member 14. The mounting member includes a retainer portion 25 retained within the channel 15 and an attachment portion 26 disposed externally thereof. Included in the retainer portion 25 are a pair of spaced apart, parallel retainer plate portions 27 that are transverse to and project into the retainer channel 15. Extending in opposite directions on each of the retainer plate portions 27 are an extension portion 28 and a projection portion 29. As shown in FIGS. 2 and 3 the extension portions 28 engage an outer surface of the outer lip 21 while the projection portions 29 engage in inner surface of the inner lip 22. The attachment portion 26 extends between the spaced apart plate portions 27 and includes a serrated edge 31 extending parallel to the top frame member 14. Projecting centrally from an opposite edge 32 of the attachment portion 26 is a flexible arm 33 that extends into the retainer channel 15 as shown in FIGS. 2 and 3. The flexible arm 33 includes an intermediate cam portion 34 bent away from the plate portions 27 and a terminal portion 35 reversely bent toward the plate portions 27.

OPERATION

After insertion of the display piece 18, the corners of the frame 11 are assembled with the angle plates 16 in a conventional manner. The mounting member 24 then is inserted in the channel 15 of the top frame member 14 as follows. First, with the extension portions 28 inclined somewhat upwardly from the lip 21, the projection portions 29 are inserted into the channel 15 underneath the inner lip 22. The retainer plate portions 27 then are pivoted within the channel 15 bringing the extension portions 28 into contact with the outer surface of the outer lip 21. During that pivotal movement of the retainer plate portions 27, the terminal portion 35 of the latch arm 33 engages the outer edge of the lip 21 in that the joint 36 between the intermediate portion 34 and the terminal portion 35 is spaced from the projection portions 29 by a distance greater than the spacing between the channel lips 21, 22. Therefore, the arm 33 is deformed inwardly as it enters the channel 15. After the joint 36 has cleared the outer edge of the lip 22, the resilient latch arm 33 returns towards its original position as the intermediate latch portion 34 enters the channel 15 and engages the inner surface of the outer lip 21. The force maintained between the still partially deformed resilient latch arm 33 and the outer lip 21 securely retains the retainer portion 25 in position within the retainer channel 15. Removal of the mounting member 24 from the retainer channel 15 merely entails a reversal of the described procedures. The exertion of force on the attachment portion 26 in a direction away from the member 14 causes the lip 21 to forcibly engage and move the cam portion 34, thereby reducing the spacing between the cam portion 34 and the projection portions 29 and allowing removal of the retainer portion from the channel 15.

After assembly, the display frame 11 is mounted by hooking one of the notches 42 in the serrated edge 31 of the mounting member 24 over an appendage 41 projecting from a suitable support surface 43 as shown in FIG. 3. It will be understood that the support surface 43 normally will consist of a vertical wall and the appendage 41 will consist of either a nail or a screw embedded therein. After the serrated edge 31 has been securely engaged with the appendage 41, the display frame 11 is horizontally adjusted with respect to the support surface 43 to obtain a balanced, orthogonally symmetrical orientation of the top frame member 14. During this horizontal adjustment of the display frame 11, the mounting member 24 remains stationary because of its engagement with the fixed appendage 41 and the retainer portion 25 slides longitudinally within the retainer channel 15. Thus, the present invention simplifies symmetrical hanging of a display by providing for relative horizontal adjustment between the display frame 11 and the concealed mounting member 24.

Obviously, many modifications and variations of the present invention are possible in light of the above teachings. It is to be understood, therefore, that the invention can be practiced otherwise than as specifically described.

What is claimed is:

1. A frame apparatus for mounting a display item on a vertical support surface and comprising:

a frame assembly comprising elongated side members each having one end joined with a different end of an elongated top member and an opposite end joined with a different end of an elongated bottom member, said members forming a rectangular enclosure for retaining a peripheral edge of the display item, said top member comprising an elongated extrusion with a rearwardly opening retainer channel, and said channel comprising a pair of longitudinally extending parallel lips separated by a rearwardly opening slot; and mounting means comprising a retainer portion retained by said channel and movable thereon along a path subtantially parallel to said elongated top member and an attachment portion disposed externally of said channel and adapted to removably engage and be supported by an appendage fixed to the support surface; said retainer portion comprising a resilient latch portion engaging an inner surface of one of said lips and a projection portion means engaging an inner surface of the other of said lips, said latch portion and said projection portion being spaced apart by a distance greater than the separation of said lips such that entry of said projection and latch portions into said channel requires temporary deformation of said resilient latch portion, and wherein said resilient latch portion comprises a resilient cam portion engaging said one lip and movable thereby to reduce said distance and permit removal of said retainer portion from said channel in response to an application of force on said attachment portion in a direction away from said top member.

2. A frame apparatus according to claim 1 wherein said retainer portion further comprises an extension portion means engaging an outer surface of said one lip.

3. A frame apparatus according to claim 2 wherein said attachment portion comprises a hanger portion adapted to be hung from the appendage.

4. A frame apparatus according to claim 3 wherein said hanger portion comprises a serrated edge extending parallel to said top member.

5. A frame apparatus according to claim 2 wherein said extension portion means comprises a pair of spaced apart extension portions engaging said outer surface of one of said lips, said projection portion means comprises a pair of spaced apart projection portions engaging said inner surface of the other of said lips, and said resilient latch portion is disposed between said extension portions.

6. A frame apparatus according to claim 5 wherein said attachment portion comprises a hanger portion adapted to be hung from the appendage.

7. A frame apparatus according to claim 6 wherein said hanger portion comprises a serrated edge extending parallel to said top member and between said projection portions.

8. A frame apparatus according to claim 5 wherein said latch portion comprises a flexible arm extending into said channel, said flexible arm having an intermediate portion forming said cam portion and projecting away from said retainer portion and engaging said inner surface of said one lip and a terminal portion projecting from said intermediate portion towards said retainer portion and adapted to engage an edge of said one lip during entry of said arm into said channel.

9. A frame apparatus according to claim 8 wherein said attachment portion comprises a hanger portion adapted to be hung from the appendage.

10. A frame apparatus according to claim 9 wherein said hanger portion comprises a serrated edge extending parallel to said top member.

* * * * *